US006302089B1

(12) United States Patent
Zimmermann

(10) Patent No.: US 6,302,089 B1
(45) Date of Patent: Oct. 16, 2001

(54) METHOD AND APPARATUS FOR CONTROLLING A ROTATABLE SHAFT

(75) Inventor: Daniel E. Zimmermann, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/315,711

(22) Filed: May 20, 1999

(51) Int. Cl.[7] ..... F02M 25/07

(52) U.S. Cl. ..... 123/568.24; 251/129.11

(58) Field of Search ..... 123/568.24, 568.23, 123/399; 335/219, 220, 223, 228; 251/129.11, 129.12

(56) References Cited

U.S. PATENT DOCUMENTS 3,877,475 * 4/1975 Dietiker ..... 431/53.24
3,884,056 * 5/1975 East et al. ..... 70/100
4,064,851 * 12/1977 Wessel ..... 123/119 B
4,660,518 * 4/1987 Tamaki ..... 123/328
4,992,766 2/1991 Suzuki et al. ..... 335/223
5,005,552 4/1991 Kawamura .
5,014,030 * 5/1991 Aston ..... 335/228
5,094,218 3/1992 Everingham et al. .
5,261,657 * 11/1993 Edin ..... 271/274
5,703,735 * 12/1997 Bleeke ..... 360/105
5,771,867 6/1998 Amstutz et al. .

* cited by examiner

*Primary Examiner*—Andrew M. Dolinar
*Assistant Examiner*—Arnold Castro
(74) *Attorney, Agent, or Firm*—Clifton G. Green; Kelsey L. Milman

(57) ABSTRACT

A device for latching a rotatable shaft. A lever arm is coupled with the shaft and rotates the shaft between a first and second positions when the lever arm rotates between respective first and second positions. A latching device latches the lever arm, in response to receiving an activation signal, when the lever arm is in the first position. The latching device holds the lever arm in the first position. A biasing device is coupled with the lever arm and exerts a biasing force on the lever arm that biases the lever arm towards the second position.

23 Claims, 2 Drawing Sheets

METHOD AND APPARATUS FOR CONTROLLING A ROTATABLE SHAFT

TECHNICAL FIELD

The present invention relates generally to rotatable shafts, and more specifically, to an apparatus for biasing a rotatable shaft.

BACKGROUND ART

Regulatory agencies such as the Environmental Protection Agency and the Engine Manufacturers Association require strict emission requirements for heavy-duty diesel engines. One method used to reduce emissions of engines is an Exhaust Gas Recirculation ("EGR") system. The EGR system controls the amount of exhaust gas that is introduced into the engine's air intake system by a valve that adjusts the flow rate based on various engine operating parameters.

In addition to the normal operation of the EGR system, most EGR systems also have a fail-safe mode that drives the EGR valve either fully closed or fully open, depending on the design of the EGR system. Typically a spring is added to the EGR system to move the EGR valve when in fail-safe mode. The spring, however, is permanently affixed, and continuously exerts a biasing force on the EGR valve, i.e., during both normal and fail-safe operation. This places a large and unnecessary load on the actuator during normal operation. The additional load increases the likelihood of the actuator overheating, or requires a more powerful actuator than would otherwise be needed.

Further, because of the high powered actuators, conventional EGR systems typically use hydraulic or pneumatic powered actuators to adjust the position of the EGR valve. Both hydraulic and pneumatic systems are, however, susceptible to leaking.

SUMMARY OF THE INVENTION

The present invention provides a method and apparatus for latching a rotatable shaft. A lever arm is coupled with the shaft and rotates the shaft between a first and second positions when the lever arm rotates between respective first and second positions. A latching device restrains the lever arm in the first position in response to receiving an activation signal. A biasing device is coupled with the lever arm and exerts a biasing force on the lever arm that biases the lever arm towards the second position.

BEST MODE OF THE INVENTION

Figure 1:
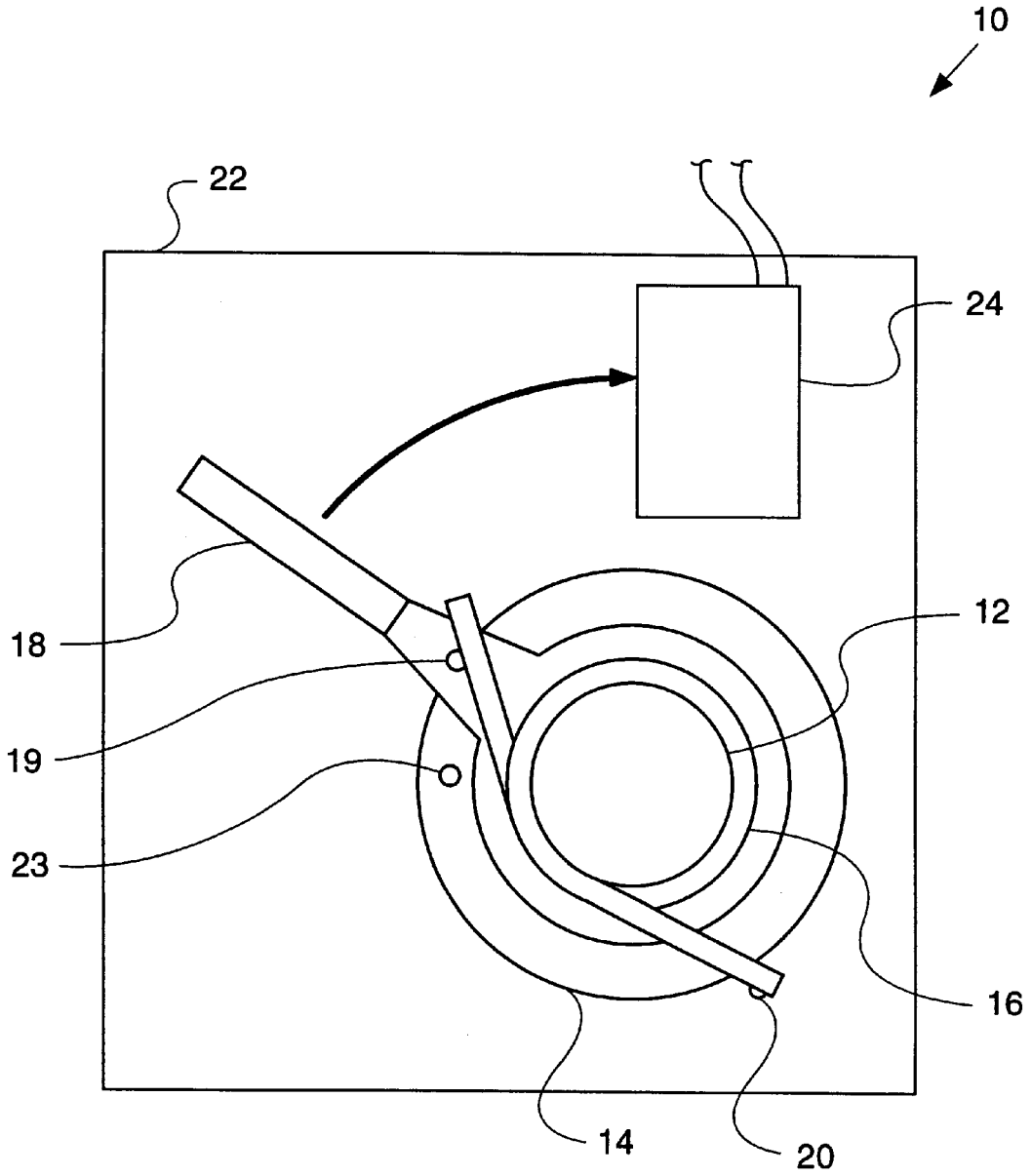
FIG. 1 is an end view of an apparatus for latching a rotatable shaft according to one embodiment of the invention.

FIG. 1 is an end view of an apparatus 10 for latching a rotatable shaft 12 according to one embodiment of the invention. A drive hub 14 is disposed around a portion of the shaft 12 such that rotation of the drive hub 14 causes rotation of the shaft 12. A biasing device, such as a cylindrical torque spring 16 is disposed around a portion of the drive hub 14.

Other types of biasing devices, including other types of springs may also be used, as appropriate. A lever arm 18, such as an armature, containing a magnetic material is coupled with the spring 16 on one end, such as by a first drive pin 19. The lever arm 18 may be entirely or only partly made of the magnetic material, or have a portion that is magnetic. The other end of the spring 16 is anchored by an anchoring device, such as an anchor pin 20. The anchor pin 20 is typically coupled with a housing 22 or other fixed object. Other types of fastening may also be used to immobilize the end of the spring 16, such as welding, for example. In that case, the anchoring device would be the weld itself. The lever arm 18 is also coupled with the drive hub 14, such as by a second drive pin 23, so that rotation of the drive hub 14 causes rotation of the lever arm 18. A latching device, such as an electrically actuated hook (not shown) or an electromagnet 24, is located a predetermined distance from the shaft 12 in the rotational path of the lever arm 18.

In operation, the shaft 12 is rotated from a first position, such as the 9 o'clock position, to a second position, such as a 12 o'clock position, with the second position being a position that causes the lever arm 18 to come in direct physical contact with the electromagnet 24. An actuator (not shown) or other appropriate device may be used to rotate the shaft 12. The electromagnet 24 is energized by an activation signal, causing the magnetic material within the lever arm 18 to be attracted to the electromagnet 24. Because the lever arm 18 is in direct contact with the electromagnet 24, i.e., there is no air gap, the amount of power used by the electromagnet 24 may be relatively small. Alternately, a more powerful electromagnet 24 or higher current may be used to attract the lever arm 18 from a distance if the lever arm 18 does not come in direct contact with the electromagnet 24 due to normal rotation of the shaft 12 from the first to second positions.

The movement of the shaft 12 loads the spring 16, biasing the lever arm 18 back towards the first position (9 o'clock). When the electromagnet 24 is de-energized, the spring 16 moves the lever arm 18 back towards the first position. The movement of the lever arm 18 rotates the drive hub 14, causing the shaft 12 to rotate back to the first position.

Significantly, the electromagnetic force exerted by the electromagnet 24 on the lever arm 18 is greater than the biasing force of the spring 16 on the lever arm 18. Thus, when the electromagnet 24 is energized, the lever arm 18 remains in physical contact with the electromagnet 24.

In an embodiment using the electrically actuated hook (not shown), the lever arm need not have any magnetic material within it. Instead, the hook may rotate into the rotational path of the lever arm 18, catching the lever arm 18.

In one embodiment, the shaft 12 may rotate without a corresponding rotation of the drive hub 14. This can be accomplished, for example, by exerting a rotational force on the shaft 12 that is greater than a frictional force between the drive hub 14 and the shaft 12, but less than the electromagnetic force acting on the lever arm 18. Thus, when the lever arm 18 is coupled with the electromagnet 23, the lever arm 18 would remain attached to the energized electromagnet 24, and the drive hub 14 would be coupled with the lever arm 18, but the shaft 12 would spin within the drive hub 14.

Similarly, in another embodiment the drive hub 14 is fixedly attached to the shaft 12, but the drive hub 14 may spin while the lever arm 18 remains in a fixed position, such as attached to the electromagnet 24. This may be accomplished by any of a variety of ways known to those skilled in the art.

In one embodiment, the lever arm 18 may be directly coupled to the shaft 12, without the presence of the drive hub 14. Typically the lever arm 18 is friction mounted to the shaft so that the rotation of the lever arm 18 causes rotation of the shaft 12, but the rotation of the shaft 12 need not cause rotation of the lever arm 18 (see discussion immediately above).

Figure 2:
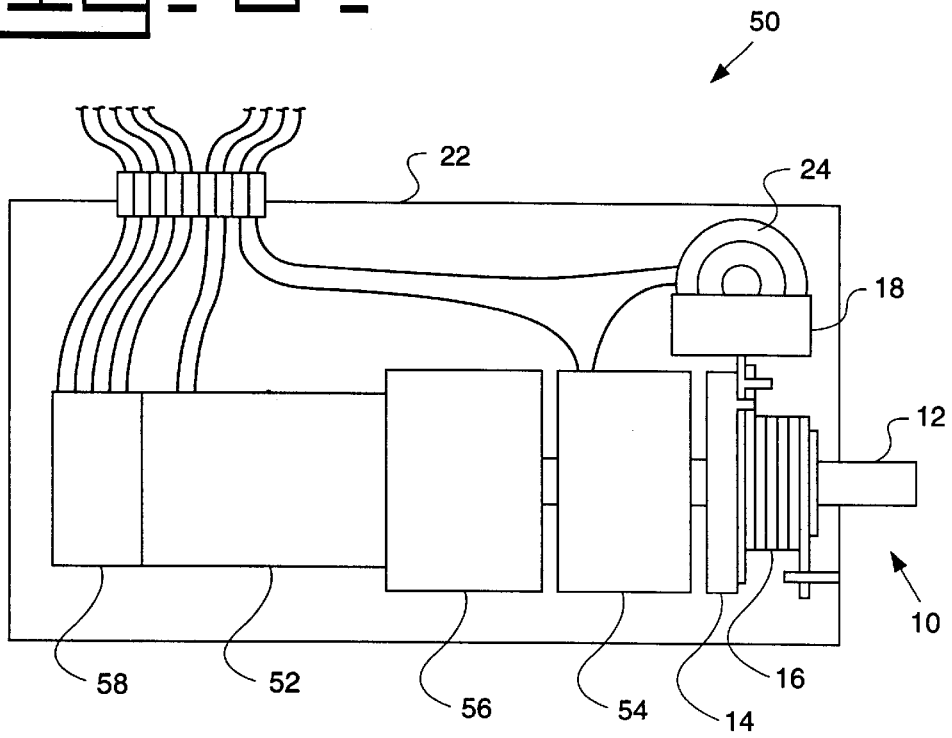
FIG. 2 is a block diagram and schematic of an actuator having the apparatus of FIG. 1 according to one embodiment of the invention.

FIG. 2 is a block diagram and schematic of an actuator 50 having the apparatus 10 according to one embodiment of the invention. The actuator 50 includes a motor 52, such as a DC motor, coupled with the shaft 12. In operation, the motor 52 may drive the shaft 12 between the first position and the second position, and typically any position therebetween. The apparatus 10 functions as discussed above, and will not be repeated. In one embodiment, the motor 52 is back driveable, so that the biasing force exerted by the spring 16 will cause the shaft 12 to rotate back towards the first position (away from the electromagnet 24).

Further, because the spring 16 is held by the electromagnet 24, via the lever arm 18, the preload (i.e., biasing) normally applied to the shaft 12 by the spring 16 in conventional actuators is not present. Thus, a smaller, i.e., less powerful, motor 52 may be used to rotate the shaft 12 than in conventional actuators. This reduction in load may also contribute to a reduction in heating of the motor 52, because it is driving a smaller load. In addition, the actuator 50 may be entirely electrically powered and driven. Therefore, hydraulic or pneumatic systems are not needed. This avoids the problem of leaking with these systems.

In another embodiment, the frictional forces within the actuator 50 are sufficiently high so as to prevent the back driving of the motor 52 by the spring 16. A clutch 54 is disposed between the motor 52 and the shaft 12, such that upon a receipt of a predetermined control signal by the clutch 54, the clutch disengages the shaft 12 from the rest of the actuator 50, allowing for the spring 16 to bias the shaft 12 towards the first position. Typically the clutch 54 is engaged when the electromagnet 24 is energized and disengaged when the electromagnet 24 is not energized. This may be accomplished by placing the clutch 54 in series with the electromagnet 24, such that the clutch 54 also receives the activation signal that energizes the electromagnet 24. Thus, the clutch 54 receives a signal indicative of the state of the electromagnet 24. Any of a variety of appropriate ways known to those skilled in the art may be used to cause the clutch 54 to engage and disengage as a function of the activation signal.

In one embodiment a gearbox 56 is disposed between the motor 52 and the shaft 12. The gearbox 56 is coupled with the motor 52 on one end, typically to a first output shaft 57 of the motor 52, and on the other end the gearbox is coupled with the shaft 12. Alternately, a clutch 54, as described above, may be coupled between the gearbox 56 and the shaft 12. The gearbox 56 is operable to rotate the shaft 12 as a function of the rotational characteristics of the first output shaft 57. Typically the gearbox 56 will rotate the shaft 12 at a different speed and torque than the first output shaft 57.

In one embodiment, a rotary position sensor 58 is coupled with the shaft 12 to detect the position of the shaft 12. The sensor 58 transmits a position signal indicative of the position of the shaft 12. The sensor 58 may be used with any of a variety of electronic controllers (not shown) to create closed loop automatic control of the position of the shaft 12. Alternately, the sensor 58 may be coupled with a portion of the motor 52, gearbox 56, clutch 54, or drive hub 14 that is indicative of the position of the shaft 12, and transmit a position signal that is a function of the position of that portion of the motor 52, gearbox 56, clutch 54, or drive hub 14. The position of the shaft 12 may then be determined from the position signal by ways known to those skilled in the art, e.g., using gear ratios. The position signal may be used as part of a closed loop control system (not shown) for automatically controlling the position of the shaft 12 by ways known to those skilled in the art.

Figure 3:
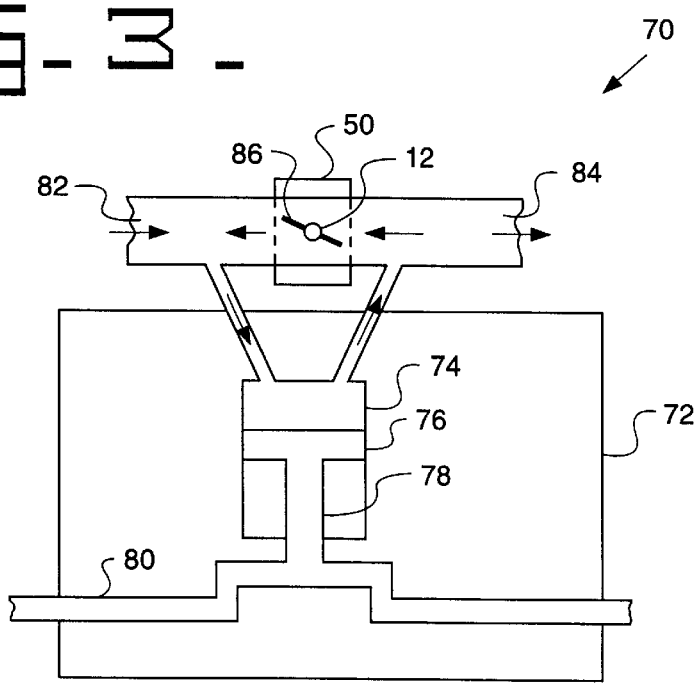
FIG. 3 is a functional block diagram of an engine having the actuator of FIG. 2 according to one embodiment of the invention.

FIG. 3 is a functional block diagram of an engine 70 having the actuator 50 according to one embodiment of the invention. The engine 70 includes an engine block assembly 72 having a variety of components known to those skilled in the art, such as a combustion chamber 74, a piston 76, a piston rod 78, a fuel injector (not shown), intake and exhaust valves (not shown), a device for operating the valves (not shown), a device for lubricating the engine (not shown), and other devices. An air intake path 82 provides air to the combustion chamber 74. The fuel injector injects fuel into the combustion chamber 74 and the combustion of the air/fuel mixture creates a first force that drives the piston 76 and piston rod 78 down, rotating the drive shaft 80. The drive shaft 80 converts the (downward) first force to a second (rotational) force. The drive shaft may also include a variety of devices for further modifications and conversions of the rotational force known to those skilled in the art, such as a transmission (not shown), for example. After combustion, the air from the combustion chamber 74 is vented by an exhaust air path 84 by ways known to those skilled in the art.

An exhaust gas recirculation valve 86 is coupled between the intake and exhaust air paths 82, 84 and is operable to divert a portion of the air from the exhaust air path 84 to the intake air path 82 by ways known to those skilled in the art. The shaft 12 of the actuator 50, described above, is coupled with the exhaust gas recirculation valve 86 and is operable to rotate the exhaust gas recirculation valve 86 between the first and second positions: typically fully closed and fully open, although the exhaust gas recirculation valve 86 may also rotate to an infinite number of positions between fully closed and open. The actuator 50 functions as described above, and will not be repeated.

Significantly, in a fail-safe mode the activation signal is not transmitted to the latching device (i.e., the electromagnet 24 or electrically actuated hook (not shown)). Thus, the spring 16 biases the shaft 12, and therefore the exhaust gas recirculation valve 86, towards a predetermined position, such as a fail-safe position.

From the foregoing it will be appreciated that, although specific embodiments of the invention have been described herein for purposes of illustration, various modifications may be made without deviating from the spirit and scope of the invention. Accordingly, the invention is not limited to the specific embodiments described herein, but instead may include other embodiments and equivalents as may fall within the scoper of the appended claims.

What is claimed is:

1. An actuator for rotating a drive shaft, comprising:

a housing;

a motor disposed within the housing and coupled with the drive shaft, the motor operable to receive a drive signal and to rotate the drive shaft between a first and second positions in response to receiving the drive signal; and an apparatus for latching the drive shaft, comprising:

a lever arm coupled with the drive shaft and operable to rotate the drive shaft between a first and second positions when the lever arm rotates between respective first and second positions;

a biasing device coupled with the lever arm, the biasing device operable to bias the lever arm towards the second position; and a latching device operable to be coupled with the lever arm and to restrain the lever arm in the first position in response to receiving an activation signal.

2. The apparatus of claim 1 wherein the lever arm comprises an armature and includes a magnetic material, and the latching device comprises an electromagnet.

3. The apparatus of claim 1 wherein the biasing device is operable to exert a biasing force on the lever arm, and the latching device is operable to exert a restraining force on the lever arm, the biasing force on the lever arm being less than the restraining force on the lever arm.

4. The apparatus of claim 1 wherein the lever arm is operable to remain in the second position when the drive shaft rotates from the second position towards the first position when the latching device is restraining the lever arm.

5. The actuator of claim 1 wherein the motor includes a first output shaft, and further comprising a gearbox coupled between the first output shaft and the drive shaft, the gearbox operable to rotate the drive shaft as a function of the rotation of the first output shaft, the rotation of the drive shaft having a speed and torque different than a speed and torque of the first output shaft.

6. The actuator of claim 1 wherein the motor includes a first output shaft, and further comprising a clutch disposed between the motor and the drive shaft, the clutch operable to disengage the drive shaft from the first output shaft in response to receiving a predetermined control signal.

7. The apparatus of claim 4 wherein the biasing device comprises a spring.

8. The apparatus of claim 7 wherein the spring comprises a cylindrical torque spring disposed around the drive shaft.

9. The apparatus of claim 8 wherein the torque spring includes a first and second tangs, and further comprising an anchoring device coupled with the first tang of the torque spring, the anchoring device operable to bias the first tang to a predetermined position, and the second tang being coupled with the lever arm.

10. The apparatus of claim 9 wherein the anchoring device is coupled with the housing.

11. The apparatus of claim 1 wherein the anchoring device comprises an anchor pin.

12. The apparatus of claim 1 wherein the second position of the lever arm comprises a position wherein the lever arm is in physical contact with the electromagnet.

13. The apparatus of claim 1, further comprising a drive hub coupled between the shaft and the biasing device, the drive hub being disposed around the drive shaft.

14. The apparatus of claim 1, further comprising a rotary position sensor disposed within the housing and coupled with the shaft, the rotary position sensor operable to detect a position of the shaft and to transmit a position signal as a function of the position of the shaft.

15. An engine, comprising:

an engine block assembly having a combustion chamber and operable to generate a first force;

a drive train coupled with the engine block assembly to receive the first force and to generate a second force as a function of the first force;

an intake air path coupled with the combustion chamber, the intake air path operable to provide air to the combustion chamber;

an exhaust air path coupled with the combustion chamber, the exhaust air path operable to vent air from the combustion chamber;

an exhaust gas recirculation valve coupled with the intake and exhaust air paths, the exhaust gas recirculation valve having a control shaft and operable to divert a portion of air from the exhaust air path into the intake air path in response to the control shaft being in a predetermined position, the magnitude of the portion being a function of the position of the control shaft; and an actuator coupled with the control shaft and operable to rotate the control shaft, comprising:

a housing;

a motor disposed within the housing and coupled with the control shaft, the motor operable to receive a control signal and to rotate the control shaft between a first and second positions in response to receiving the control signal; and an apparatus for latching the control shaft, comprising:

a lever arm coupled with the control shaft and operable to rotate the control shaft between a first and second positions when the lever arm rotates between respective first and second positions;

a biasing device coupled with the lever arm, the biasing device operable to bias the lever arm towards the second position; and a latching device operable to be coupled with the lever arm and to restrain the lever arm in the first position in response to receiving an activation signal.

16. The apparatus of claim 15 wherein the lever arm comprises an armature and includes a magnetic material, and the latching device comprises an electromagnet.

17. The apparatus of claim 15 wherein the biasing device is operable to exert a biasing force on the lever arm, and the latching device is operable to exert a restraining force on the lever arm, the biasing force on the lever arm being less than the restraining force on the lever arm.

18. The apparatus of claim 15 wherein the lever arm is operable to remain in the second position when the control shaft rotates from the second position towards the first position when the latching device is restraining the lever arm.

19. The actuator of claim 15 wherein the motor includes a first output shaft, and further comprising a clutch disposed between the motor and the control shaft, the clutch operable to disengage the control shaft from the first output shaft in response to receiving a predetermined control signal.

20. The apparatus of claim 15 wherein the biasing device comprises a cylindrical torque spring disposed around the control shaft.

21. The apparatus of claim 15 wherein the second position of the lever arm comprises a position wherein the lever arm is in physical contact with the restraining device.

22. The apparatus of claim 15, further comprising a drive hub coupled between the control shaft and the biasing device, the drive hub being disposed around the control shaft.

23. The apparatus of claim 15, further comprising a rotary position sensor disposed within the housing and coupled with the control shaft, the rotary position sensor operable to detect a position of the control shaft and to transmit a position signal as a function of the position of the control shaft.

* * * * *

UNITED STATES PATENT AND TRADEMARK OFFICE

CERTIFICATE OF CORRECTION

PATENT NO. : 6,302,089 B1
DATED : October 16, 2001
INVENTOR(S) : Daniel E. Zimmermann It is certified that error appears in the above-identified patent and that said Letters Patent is hereby corrected as shown below:

Column 5,
Line 44, delete "1" and insert -- 9 --

Signed and Sealed this

Fourteenth Day of May, 2002

*Attest:*

*Attesting Officer*

JAMES E. ROGAN
*Director of the United States Patent and Trademark Office*